US005316231A

United States Patent [19]

Thievessen et al.

[11] Patent Number: 5,316,231

[45] Date of Patent: May 31, 1994

[54] UNWINDING APPARATUS FOR WOUND ROLLS

[75] Inventors: Karl Thievessen, Grevenbroich; Peter Weiss, Neuss, both of Fed. Rep. of Germany

[73] Assignee: Jagenberg Aktiengesellschaft, Dusseldorf, Fed. Rep. of Germany

[21] Appl. No.: 830,406

[22] Filed: Jan. 31, 1992

[30] Foreign Application Priority Data

Feb. 1, 1991 [DE] Fed. Rep. of Germany ..... 4103057

[51] Int. Cl.[5] ..... B65H 19/12

[52] U.S. Cl. ..... 242/58.6

[58] Field of Search ..... 242/58.6, 58, 79, 86.52, 242/85, 54 R, 129.51, 129.53, 68.4, 78.6

[56] References Cited

U.S. PATENT DOCUMENTS

| | | | |
|---|---|---|---|
| 2,346,948 | 4/1944 | Shackelford et al. | 242/58.6 |
| 2,652,207 | 9/1953 | Goedken | 242/58.6 |
| 2,738,935 | 3/1956 | Greene | 242/58.6 |
| 3,329,369 | 7/1967 | Guthrie | 242/58.6 |
| 3,373,952 | 3/1968 | Klaczkiewicz | 242/66 |
| 4,699,329 | 10/1987 | Strohmeyer | 242/65 |

FOREIGN PATENT DOCUMENTS

| | | |
|---|---|---|
| 3207366A1 | 9/1983 | Fed. Rep. of Germany . |
| 2511351 | 2/1983 | France . |

*Primary Examiner*—John M. Jillions

*Attorney, Agent, or Firm*—Herbert Dubno; Yuri Katesaov

[57] ABSTRACT

An unwinding device for rolls of paper or cardboard has a pair of stands which are movable toward and away form one another on release by motors which have sprockets engaging nontraveling chains fixed at their ends relative to the rails. The stands have bearing housings displaceable vertically thereon and carrying heads engaging in the roll and vertically shifted by piston-and-cylinder assembly in the plane of the uprights of the stand.

4 Claims, 2 Drawing Sheets

UNWINDING APPARATUS FOR WOUND ROLLS

FIELD OF THE INVENTION

Our present invention relates to an unwinding apparatus for wound rolls of a web of material, for example, a paper roll or a roll of paperboard or cardboard.

More particularly, the unwinding apparatus or lift stand for a wound roll, which may be provided upstream of a processing or treatment unit for the paper or cardboard, for example, a transverse cutter for severing the web material into sheets, is intended to engage the roll with a pair of engaging heads or cones which can fit into the winding sleeve or core on which the roll is wound and can include vertical stands on which the heads are vertically displaced so that the full roll is engaged between heads in the upper position and the heads can be lowered during the operation of the machine.

BACKGROUND OF THE INVENTION

Unrolling devices or roll stands which can support a roll of paper or cardboard for feeding the web to a machine for the processing of the web are known in a variety of configurations. Some configurations employ mandrels or axles onto which the roll is threaded and in which the axle is supported on trunnions.

In another configuration, engaging heads or cones are provided which fit into the winding sleeve or core upon which the roll is wound, the support cones being mounted on respective stands which can be moved closer or further apart in the direction of the axis of the roll and of the cones to adjust for different roll lengths and web widths. A typical processing machine for which the unrolling device may be provided can be a transverse cutting machine which severs the web into sheets of given length.

To load the device with a new wound roll, for removing a roll residue including the tubular core and for adjusting the device for different web widths, the displacement of at least one of the stands relative to the other in the axial direction is possible. Depending upon the diameter of the wound roll which is to be accommodated, the clamping cones may have to be raised or lowered on the respective stands.

German patent document 32 07 366 discloses an unrolling device for the purposes described in which the clamping heads which engage the wound roll from opposite ends, can be vertically movable by a lifting device. For this purpose the clamping heads may be mounted on support arms which can be shiftable on a horizontal beam to allow axial adjustment to different roll lengths and for engagement of the roll between the arms and the beam is here vertically shiftable. The support arms can extend in or counter to the direction of travel of the web as cantilever arms from lateral supports.

With heavy wound rolls, high torques are generated with these systems so that the supports for the device must be very massive to render them capable of taking up these torques. As a consequence,, the means for effecting vertical movement of the support arms must be expensive and complex.

A roll-lift stand is disclosed in U.S. Pat. No. 2,346,948 in which behind each of two stand members and in the vertical plane of the axis of the wound roll supported in the stand, a respective hydraulic piston-and-cylinder unit is provided. The movable member of these units, namely the piston, carries a roll over which a cable passes to engage a bearing housing in which the engaging cones are journaled. The apparatus eliminates the drawback of the first-mentioned prior art device with respect to the high torques which result when large rolls are carried but the construction is space-consuming and massive as well.

In U.S. Pat. No. 1,874,904, another roll support device is provided in which the rail-engaging members ride up and down on respective posts which are displaceable by windlasses at the top of each stand. A problem with plural windlasses is, of course, that there may be a disorientation of the two windlasses which can result in a canting of the device and problems as a result thereof.

OBJECTS OF THE INVENTION

It is, therefore, the principal object of the present invention to provide an improved, highly reliable roll-unwinding device which allows a wound roll to be raised from the floor to an elevated position, especially for heavy rolls, whereby drawbacks of the earlier devices are avoided.

A more specific object of this invention is to provide a highly compact roll-unwinding device which is free from the need for massive structures to take up high torques and yet is of simple, low-maintenance construction.

SUMMARY OF THE INVENTION

These objects and others which will become apparent hereinafter are attained, in accordance with the invention, in an unwinding device for the purposes described which comprises:

a pair of spaced-apart generally upright stands forming vertical guides;

a respective bearing housing received in each guide and vertically displaceable therealong;

a respective engaging head journaled in each of the housings and engageable in a respective end of a winding tube on which the roll is wound for supporting the roll;

a respective piston-and-cylinder assembly mounted on each stand in a common vertical guide plane with the respective guide and laterally offset from the respective housing, each assembly having a vertically displaceable roller in the plane;

at least one guide roller on each stand above the respective housing in the respective plane; and a respective traction chain in the respective plane passing around the vertically displaceable roller of each assembly and around the respective guide roller and extending vertically from above into engagement with the respective housing symmetrically with respect to a vertical plane of symmetry including axes of the heads and perpendicular to the guide planes.

Because the traction chain is secured directly and centrally to the raisable and lowerable bearing housing and the chain, the guide rollers on each stand and the piston-and-cylinder assembly actuating the chain all lie in a common plane perpendicular to the axis of the roll-engaging head or cone and because the chain attachment is in the axial plane of the roll which constitutes a plane of symmetry of the device, perpendicular to the aforementioned guide planes, torques about an axis parallel to the rotation axes of the engaging heads are avoided. This greatly simplifies the construction.

An important advantage of the invention, where the piston-and-cylinder assembly is mounted on the stand vertically and parallel to the guides on which the bearing housing is shiftable, i.e. on one of the guide posts laterally, is the highly compact configuration of the device which ensures that a number of unwinding devices can be disposed adjacent one another in the direction of the roll axes. Particularly small space is occupied by each device and the reduced dimensions in the web travel direction as well as in the height and in the width have been found to be of great importance in modern factories. Indeed, the unwinding device of the invention may make use of less space in the height and in the web travel direction than the maximum diameter of a wound roll. Below ground foundations are generally not required.

According to a feature of the invention, the traction chain and the rolls between the assembly and the bearing housing on each stand form a 2/1 ratio transmission which allows a piston-and-cylinder unit to be employed which projects only slightly above the uppermost position of the respective engaging head or cone.

It has been found to be advantageous to mount each stand upon a pair of rails on the floor so that the stands can be moved toward and away form one another to permit replacement of a roll or adjustment for the web width and roll length. The means for shifting at least one of the stands in the axial direction for this purpose can include a nontraveling chain mounted on the floor or on these rails and engaged by a pinion of a motor carried by the movable stand or stands.

The nonmovable chain cooperating with a motor fixed on the stand also contributes to the compactness of the apparatus of the invention.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
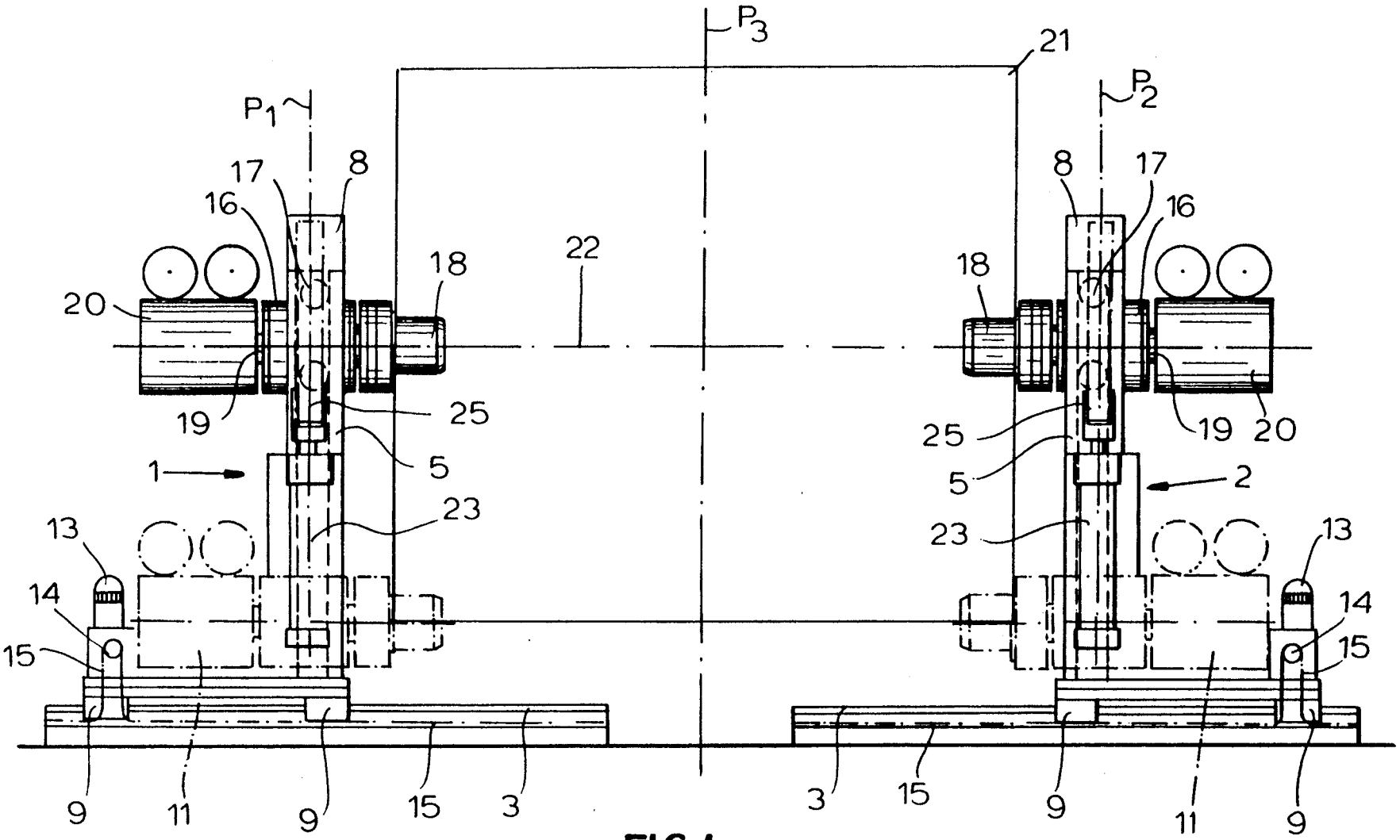
FIG. 1 is a front elevational view of a roll and winding device according to the invention, seen in the direction of web travel.
Figure 2:
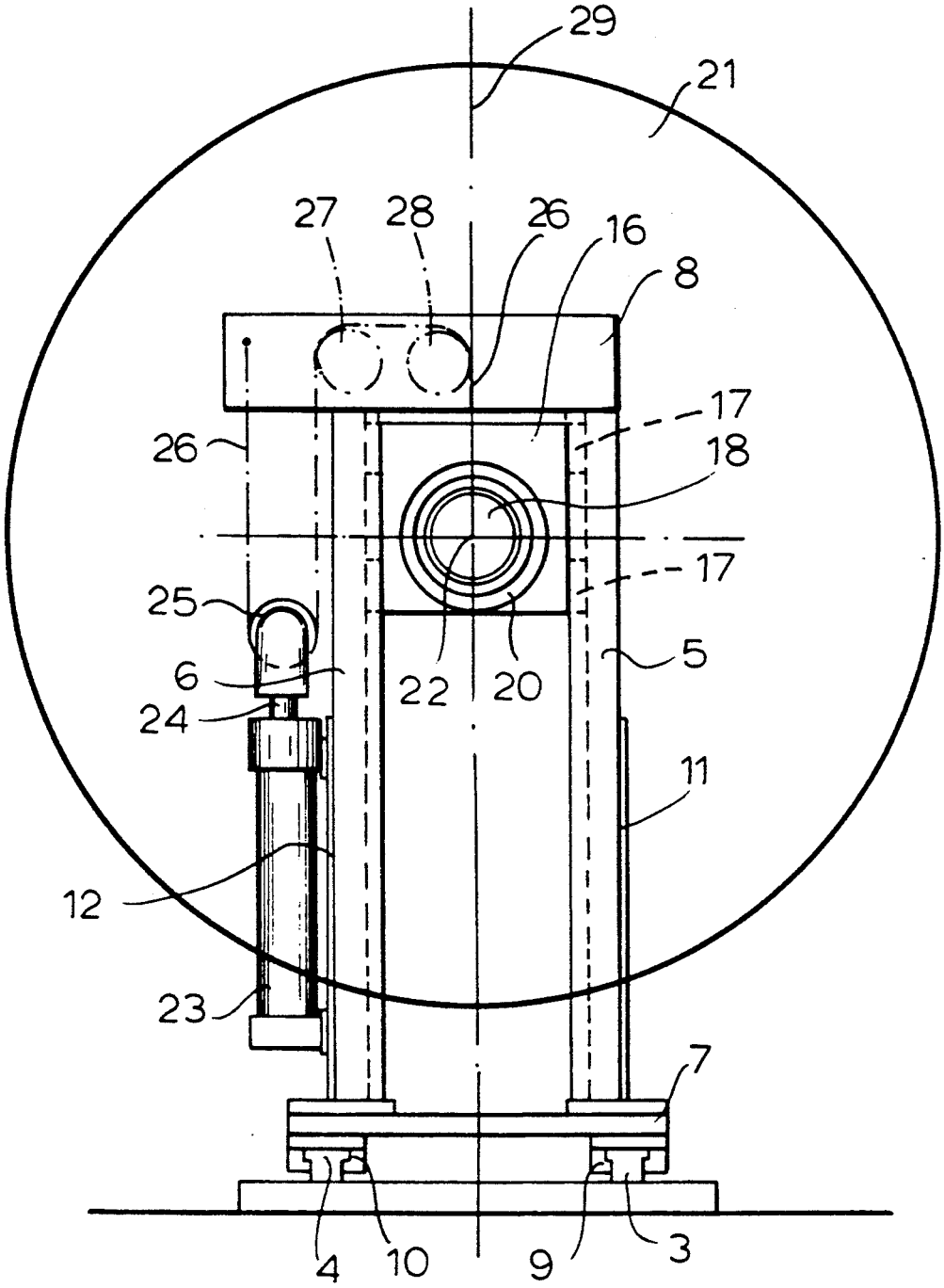
FIG. 2 is a side elevational view of the device.

The unwinding device in FIGS. 1 and 2 comprises two mirror symmetrical spaced-apart stands 1 and 2. The stands 1 and 2 are slidable on two parallel rails 3 and 4 fastened on the ground or to the floor and of a T-shaped cross section. The rails 3 and 4 are engaged by slide blocks 9 and 10 fastened on the underside of a base plate 7 of each stand. Each stand also comprises two upright posts 5 and 6 of Unshaped cross section affixed to the base plate 7 and bridged at their upper ends by a traverse 8. Outer plates 11 and 12 are welded to the posts 5 and 6 and to the base plates 7.

The drives for the transverse displacement of the stands 1 and 2, i.e. displacement along the axis 22 of a roll 21 to be mounted on the stand, include electrical or hydraulic motors 13 mounted upon the respective base plate and having pinions 14 which are partly looped by chains 15 mounted between rails 3 and 4 on the floor and secured at both ends against longitudinal movement.

The posts 5 and 6 are channels which open toward one another and define a vertical guide for a bearing housing 16 of each stand. The guides, the bearing housing and the assemblies for raising and lowering the bearing housings lie in planes P1 and P2 which are perpendicular to the axis 22, perpendicular to the plane of the paper in FIG. 1 and parallel to the plane of the paper in FIG. 2. A symmetry plane 29 which is vertical and extends through the axis 22 lies perpendicular to the planes P1 and P2. The plane of mirror symmetry is represented at P3 in FIG. 1 and is parallel to the planes P1 and P2.

Each bearing housing 16 has lateral rollers 17 whose axes extend in the web travel direction and which ride in the U channels of the posts 5 and 6 like a linear bearing system. The guide function of the rollers 17 can also be taken up by lateral slide blocks.

Centrally projecting from and journaled in each bearing housing 16 is a horizontal engaging head 18 which is intended to project into a respective end of the tube upon which the roll is wound.

Each head 18 is mounted upon a shaft 19 projecting from the respective bearing housing. At least on one and preferably on both of the stands 1 and 2, the shafts 19 are provided with brakes 20 which are mounted on the outer side of the respective bearing housing 16. In FIG. 1, the bearing housing 16 with its head 18 and brake 20 is shown in the lower unloading position at which the core tube is removed with any residue of the roll in dot-dash lines.

The bearing housing 16 with its head 18 and brake 20 is raised and lowered by a lifting drive which engages the bearing housing 16 centrally and is thus symmetrical to the vertical plane 29 to move the head from its lower roll-receiving and tube-removal position into an upper unwinding position. The lifting mechanism is best seen in FIG. 2.

On one lateral plate 12 and post 6 of each stand, a cylinder 23 of a hydraulic piston-and-cylinder assembly is affixed on an outer side and extends vertically.

The length of the cylinder 23 amounts to about 1/2 the height of the post 6 so that the piston rod 22 in its extended position approximately reaches the level of the traverse 8.

A free running sprocket wheel or roller 25 is mounted at the upper end of the piston rod 24 and is looped by a traction chain 26, one end of which is anchored to the traverse S. The other end of the chain 26 extends vertically downwardly to engage the bearing housing 16 centrally.

The chain is guided over two guide wheels or sprockets 27, 28 journaled on the traverse 8. The wheel 25 lies between the connection of the chain to the traverse 8 and the first wheel 27 while the second wheel 28 lies generally tangent to the plane 29. This arrangement of the chain and sprocket wheels provides a 2/1 transmission of the movement of the piston rod 24 to the bearing housing 16. This causes the movement of the bearing housing 16 from the floor to the unwinding position below the traverse 8 in highly compact arrangement of the piston-and-cylinder assembly 23, 24 vertically adjacent the post 6 so that the piston rod 24 need only make 1/2 of the stroke of the bearing housing 16.

It is important that the forces applied by the assembly be symmetrically transferred to the bearing housing 16 with respect to the plane 29 so that, upon lifting of the wound rolls 21, no torque about an axis parallel to the axis 22 of the head 18 will arise. This significantly simplifies construction.

Of course, additional chains can be provided symmetrically at each stand as well, if desired.

The unwinding device can lift a full roll delivered by a floor conveyor to the winding position. Separate lifting devices such as lifting tables, cranes and the like are not required. The dimensions of the device in the direction of travel of the web and as to its height are small.

No special below-ground foundation is required. The compact construction allows a number of roll-unwinding devices to be provided one behind the other and even allows a number of webs to be fed in superposed fashion to the web-processing machine, e.g. a transverse cutter. The unrolling device can be provided in a stand accommodating a plurality of such unrolling devices. Above the rolling devices, the longitudinal girders of a frame for the machine can be provided in which guide rolls and, if desired, splicing devices for a web can be mounted.

The fully wound roll may be supplied by a floor conveyor running in the web supply direction, preferably a chain conveyor. Lateral supply transverse to the web feed direction is also possible however.

By the movement of the one or both stands, 1, 2, they are moved apart and a wound roll 21 inserted between the heads 18. The heads 18 engage in the sleeve or tube of the wound roll and the latter is then raised by the piston-and-cylinder units 23, 24 into the upper or unwound position. After the roll has been unwound, the roll residue is lowered and carried off by the floor conveyor and a new roll is introduced.

We claim:

1. An unwinding apparatus for a wound roll of a web, comprising:

a pair of spaced-apart generally upright stands forming vertical guides, each of said guides having a pair of spaced apart vertical posts and a traverse bridging opposite upper ends of said posts;

a respective bearing housing received in each guide and vertically displaceable therealong;

a respective engaging head journaled in each of said housings and engageable in a respective end of a winding tue on which the roll is wound for supporting said roll, said head of each housing lying inwardly of the posts thereof;

a respective drawing piston-and-cylinder assembly mounted on each stand in a common vertical guide plane with the respective guide, laterally offset from the respective housing and laterally outwardly of a respective post thereof, each of said assemblies having a vertically displaceable sprocket in said plane;

at least one guide roller on each stand journaled in a respective traverse above the respective housing in the respective plane;

a respective traction chain in the respective guide plane passing around the vertically displaceable sprocket of each assembly and around the respective guide roller and having a respective vertical stretch extending vertically from above into engagement with the respective housing symmetrically with respect to a vertical plane of symmetry including axes of said heads and perpendicular to said guide planes each chain having one end anchored to the respective traverse, passing under the respective sprocket, passing over the respective guide roller and extending vertically downward in the vertical plane of symmetry to the respective housing; and a brake engaging the head on at least one of said housings and mounted on a portion thereof externally of a space between said stands.

2. The unwinding apparatus defined in claim 1 wherein said sprockets, rollers and chain of each of said stands is constructed to provide a 2/1 transmission between the respective piston-and-cylinder assembly and the respective housing for displacing same.

3. The unwinding apparatus defined in claim 2, further comprising rails extending parallel to said axes, said stands being mounted on said rails, at least one of said stands being provided with a motor for displacing said one of said stands along said rails transverse to a web travel direction.

4. The unwinding apparatus defined in claim 3 wherein a nontravelling chain is provided on a floor parallel to said rails and is engaged by a sprocket driven by said motor and partly looped around said sprocket.

* * * * *